US012110619B2

(12) United States Patent
Ota et al.

(10) Patent No.: US 12,110,619 B2
(45) Date of Patent: Oct. 8, 2024

(54) SOCK

(71) Applicants: Marubeni Fashion Link Co., Ltd., Tokyo (JP); SUKENO CO., LTD., Takaoka (JP)

(72) Inventors: Norio Ota, Yokohama (JP); Masahiko Sukeno, Takaoka (JP)

(73) Assignees: Marubeni Fashion Link Co., Ltd., Tokyo (JP); SUKENO CO., LTD., Takaoka (JP)

( * ) Notice: Subject to any disclaimer, the term of this patent is extended or adjusted under 35 U.S.C. 154(b) by 269 days.

(21) Appl. No.: 16/477,632

(22) PCT Filed: Jan. 30, 2019

(86) PCT No.: PCT/JP2019/003232
§ 371 (c)(1),
(2) Date: Jul. 12, 2019

(87) PCT Pub. No.: WO2019/163456
PCT Pub. Date: Aug. 29, 2019

(65) Prior Publication Data

US 2020/0407893 A1 Dec. 31, 2020

(30) Foreign Application Priority Data

Feb. 26, 2018 (JP) ..... 2018-032433

(51) Int. Cl.
*D04B 1/26* (2006.01)
*D04B 1/10* (2006.01)

(52) U.S. Cl.
CPC ..... *D04B 1/26* (2013.01); *D04B 1/108* (2013.01)

(58) Field of Classification Search
CPC ..... D04B 1/26; D04B 1/265; D04B 1/108
See application file for complete search history.

(56) References Cited

U.S. PATENT DOCUMENTS 271,338 A * 1/1883 Lasher ..... D04B 1/108 66/187
3,603,116 A * 9/1971 Turini ..... D04B 9/56 66/187

(Continued)

FOREIGN PATENT DOCUMENTS

DE 1560993 A1 * 10/1970 ..... D04B 1/265
EP 2199445 A1 * 6/2010 ..... D04B 1/108

(Continued)

OTHER PUBLICATIONS

Office Action for Japanese Patent Application No. 2018-032433, mailed Sep. 25, 2018.

*Primary Examiner* — Megan E Lynch
(74) *Attorney, Agent, or Firm* — Merchant & Gould P.C.

(57) ABSTRACT

A sock (1) comprises a heel part (H) between a tubular leg part (L) and a tubular sole part (S), which comprises mesh-number varying regions (V1-V6) arranged along a knitting axis (K), and tubular regions (C1-C5) arranged between the mesh-number varying regions. The mesh-number varying regions include an upper region (V1), a lower region (V6), and intermediate regions (V2-V5). The number of courses of the upper region (CV1) is smaller than the number of courses of the lower region (CV6) and the number of courses of the intermediate regions (CV2-CV5). The mesh-number varying regions are constituted by mesh-number increasing regions (V1, V3, V5) and mesh-number reducing regions (V2, V4, V6) alternatingly arranged along the knitting axis. The number of courses of the tubular regions (CC1-CC5) is smaller than the number of courses of the mesh-number varying regions (CV1-CV6).

4 Claims, 5 Drawing Sheets

(56) References Cited

U.S. PATENT DOCUMENTS

| | | | | |
|---|---|---|---|---|
| 4,341,097 | A * | 7/1982 | Cassidy, Sr | D04B 1/108 66/187 |
| 4,898,007 | A * | 2/1990 | Dahlgren | A41B 11/003 2/239 |
| 5,103,656 | A | 4/1992 | Hanson | |
| 6,178,785 | B1 | 1/2001 | Samata | |
| 2005/0115284 | A1* | 6/2005 | Dua | A43B 23/042 66/178 R |
| 2006/0085894 | A1* | 4/2006 | Yakopson | A61F 13/08 2/239 |
| 2009/0000339 | A1* | 1/2009 | Dahlgren | D04B 1/26 66/187 |
| 2009/0100877 | A1* | 4/2009 | Kaneda | D04B 1/102 66/182 |
| 2011/0107501 | A1* | 5/2011 | Kawahara | A41B 11/02 2/239 |
| 2011/0302699 | A1* | 12/2011 | Kaneda | D04B 1/26 2/239 |
| 2016/0076175 | A1* | 3/2016 | Rock | A61F 13/08 66/171 |
| 2016/0340811 | A1* | 11/2016 | Roe | A41B 11/005 |
| 2016/0340813 | A1* | 11/2016 | Amis | A41B 11/003 |
| 2018/0094367 | A1* | 4/2018 | Kaneda | D04B 1/108 |

FOREIGN PATENT DOCUMENTS

| | | | | |
|---|---|---|---|---|
| GB | 835263 | A * | 5/1960 | D04B 1/265 |
| JP | S52-069334 | U1 | 5/1977 | |
| JP | H10-131002 | A | 5/1998 | |
| JP | H11-001849 | A | 1/1999 | |
| JP | 2011-164405 | B | 6/2001 | |
| JP | 2005-307370 | A | 11/2005 | |
| JP | 2010-242262 | A | 10/2010 | |
| JP | 2011-058111 | A | 3/2011 | |
| JP | 2011-256506 | A | 12/2011 | |
| JP | 2012-251290 | A | 12/2012 | |
| JP | 5204026 | B | 6/2013 | |
| JP | 5204026 | B2 * | 6/2013 | D04B 1/108 |
| JP | 2015-030958 | A | 2/2015 | |
| WO | 2010/004966 | A1 | 1/2010 | |

* cited by examiner

SOCK

This application is a National Stage Application of PCT/JP2019/003232, filed Jan. 30, 2019, which claims benefit of Japanese Patent Application No. 2018-032433, filed Feb. 26, 2018, which applications are incorporated herein by reference. To the extent appropriate, a claim of priority is made to each of the above-disclosed applications.

TECHNICAL FIELD

The present disclosure relates to a sock.

BACKGROUND

A sock is known which includes a tubular leg part, a tubular foot part, and a heel part between the leg part and the foot part, wherein the heel part is composed of a mesh-number reducing region, a cylindrically knitted region at a top of heel, a mesh-number varying region, a cylindrically knitted region at a center of heel, a mesh-number varying region, a cylindrically knitted region at a bottom of heel, and a mesh-number increasing region, which are sequentially formed from the leg portion (refer to, for example, Patent Literature 1). According to Patent Literature 1, by forming the sock in this way, it is possible to realize a sock having a heel part with a shape close to that of the heel portion of a foot.

CITATION LIST

Patent Literature

PTL 1: Patent Literature 1: Japanese Unexamined Patent Publication (Kokai) No. 2010-242262

SUMMARY OF INVENTION

Technical Problem

However, there are variations in foot lengths or sizes of wearers due to, for example, age, gender, race, etc. Thus, in order to provide socks suitable for a plurality of wearers, it is necessary to produce multiple types of socks. However, this is not realistic. In other words, a so-called size-free sock that can accommodate variations in foot lengths of wearers is desired. However, the above-described Patent Literature 1 does not disclose this problem in anyway, and naturally, discloses no measure to solve this problem.

Solution to Problem

According to one aspect of the present disclosure, there is provided a sock formed by circular knitting or flat knitting along a knitting axis, the sock comprising: a tubular leg part; a tubular sole part; and a heel part between the leg part and the sole part, the heel part comprising: a plurality of mesh-number varying regions arranged along the knitting axis; and a plurality of tubular regions arranged between every two adjacent the mesh-number varying regions, the mesh-number varying regions including: an upper mesh-number varying region connected to a lower edge of the leg part; a lower mesh-number varying region connected to an upper edge of the sole part; and a plurality of intermediate mesh-number varying regions between the upper mesh-number varying region and the lower mesh-number varying region, wherein the number of courses of the upper mesh-number varying region is smaller than the number of courses of the lower mesh-number varying region and the number of courses of the intermediate mesh-number varying regions, wherein the mesh-number varying regions are constituted by mesh-number increasing regions and mesh-number reducing regions alternatingly arranged along the knitting axis, and wherein the number of courses of the tubular regions is smaller than the number of courses of the mesh-number varying regions. The upper mesh-number varying region may be constituted by a mesh-number increasing region and the lower mesh-number varying region may be constituted by a mesh-number reducing region. The number of the mesh-number varying regions may be six and the number of the tubular regions is five, or the number of the mesh-number varying regions is eight and the number of the tubular regions is seven.

According to another aspect of the present disclosure, there is provided a sock formed by circular knitting or flat knitting along a knitting axis, the sock comprising: a tubular leg part; a tubular sole part; and a heel part between the leg part and the sole part, the heel part comprising: a plurality of mesh-number varying regions arranged along the knitting axis; and a plurality of tubular regions arranged between every two adjacent the mesh-number varying regions, the mesh-number varying regions including: an upper mesh-number varying region connected to a lower edge of the leg part; a lower mesh-number varying region connected to an upper edge of the sole part; and a plurality of intermediate mesh-number varying regions between the upper mesh-number varying region and the lower mesh-number varying region, wherein the mesh-number varying regions are constituted by mesh-number increasing regions and mesh-number reducing regions alternately arranged along the knitting axis, and wherein the number of courses of the tubular regions is smaller than the number of courses of the mesh-number varying regions. The upper mesh-number varying region may be constituted by a mesh-number increasing region and the lower mesh-number varying region may be constituted by a mesh-number reducing region.

Advantageous Effects of Invention

It is possible to provide a so-called size-free sock which can adapt to variations in foot lengths of wearers.

DESCRIPTION OF EMBODIMENTS

Figure 1:
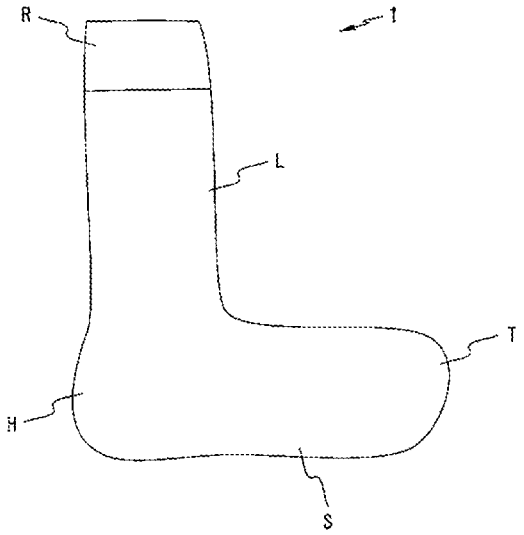
FIG. 1 is a plan view of a sock.

With reference to FIG. 1, a sock 1 of an embodiment according to the present disclosure comprises a ribbed top part R, a leg part L, a heel part H, a sole part or foot part S. and a toe part T.

Figure 9:
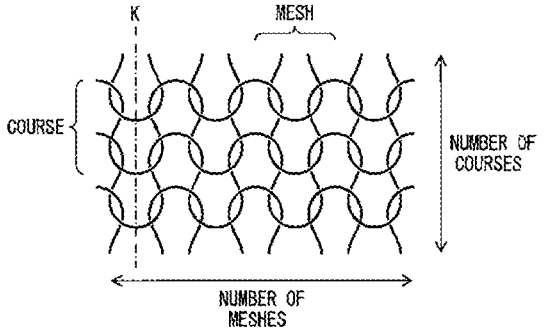
FIG. 9 is a partial enlarged view of a sock.

The sock 1 is formed by circular knitting or flat knitting. A direction from the heel part H toward the leg part L is referred to as an upward direction and a direction from the heel part H toward the sole part S is referred to as a downward direction, here. In the sock 1 of an embodiment according to the present disclosure, the ribbed top part R, the leg part L, the heel part H, the sole part S, and the toe part T are formed in this order along the knitting axis from upwards toward downwards. Specifically, referring to FIG. 9, the knitting is proceeded in a direction perpendicular to the knitting axis K. As a result, a plurality meshes or stitches are aligned in a row in the direction perpendicular to the knitting axis K. In general, this row of meshes is referred to as a course. When the number of meshes formed in a certain course reaches a prede-termined number, knitting in this course is completed, and knitting in the next course (i.e., in the lower course in an embodiment according to the present disclosure) is then started. In another embodiment (not shown), the sock 1 is knitted along the knitting axis from downwards toward upwards.

Figure 2:
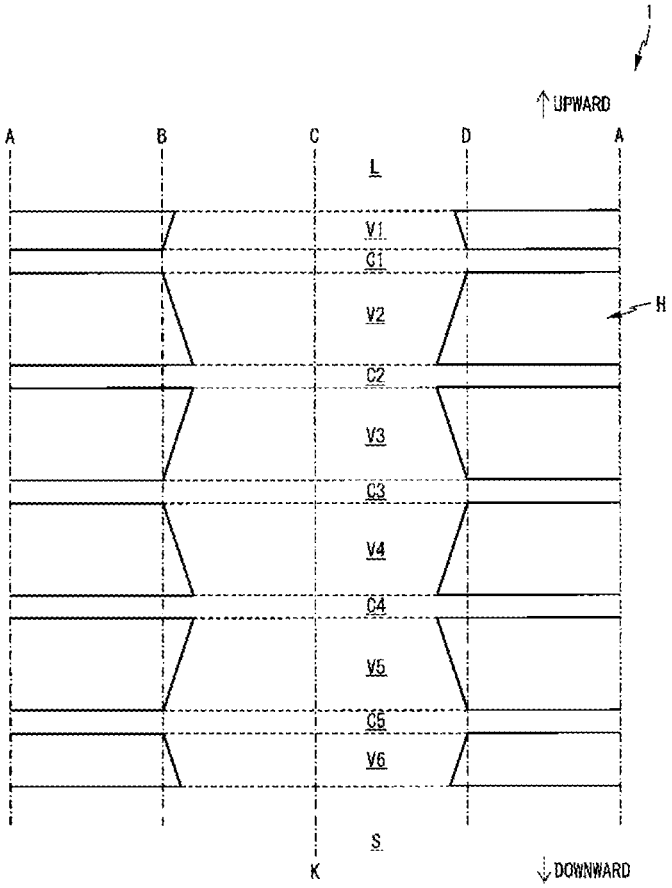
FIG. 2 is a partial development view of the sock.
Figure 3:
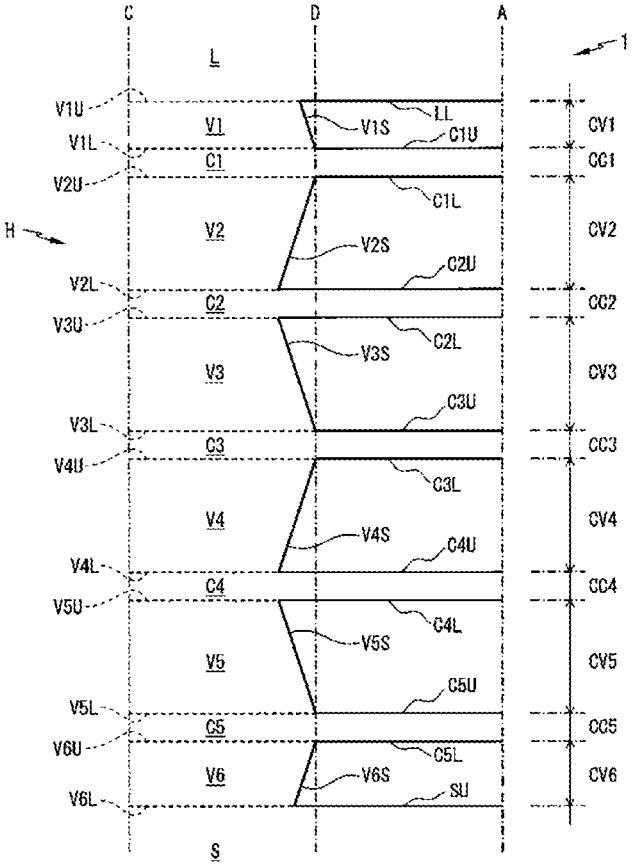
FIG. 3 is a partially enlarged development view of the sock.

FIG. 2 shows a development view of an area around the heel part H of the sock 1 of an embodiment according to the present disclosure, and FIG. 3 shows a partially enlarged view thereof. With reference to FIG. 2 and FIG. 3, the heel part H of an embodiment according to the present disclosure comprises a plurality of mesh-number varying regions V1, V2, V3, V4, V5, and V6 arranged along the knitting axis K and a plurality of tubular regions C1, C2, C3, C4, and C5 arranged between the mesh-number varying regions V1, V2, V3, V4, V5, and V6. In this connection, it may be considered that a plurality of mesh-number varying regions V1, V2, V3, V4, V5, and V6 and a plurality of tubular regions C1, C2, C3, C4, and C5 are alternately arranged. Alternatively, it may be considered that a plurality of mesh-number varying regions V1, V2, V3, V4, V5, and V6 are separated from each other by tubular regions C1, C2. C3, C4, and C5.

More specifically, in an embodiment according to the present disclosure, an upper edge V1U of the mesh-number varying region V1 is connected to a lower edge LL of the leg part L, as specifically shown in FIG. 3. An upper edge C1U of a first tubular region C1 is connected to a lower edge VL of the first mesh-number varying region V1. An upper edge V2U of a second mesh-number varying region V2 is connected to a lower edge C1L of the first tubular region C1. An upper edge C2U of a second tubular region C2 is connected to a lower edge V2L of the second mesh-number varying region V2. An upper edge V3U of a third mesh-number varying region V3 is connected to a lower edge C2L of the second tubular region C2. An upper edge C3U of a third tubular region C3 is connected to a lower edge V3L of the third mesh-number varying region V3. An upper edge V4U of a fourth mesh-number varying region V4 is connected to a lower edge C3L of the third tubular region C3. An upper edge C4U of a fourth tubular region C4 is connected to a lower edge V4L of the fourth mesh-number varying region V4. An upper edge V5U of a fifth mesh-number varying region V5 is connected to a lower edge C4L of the fourth tubular region C4. An upper edge C5U of a fifth tubular region C5 is connected to a lower edge V5L of the fifth mesh-number varying region V5. An upper edge V6U of a sixth mesh-number varying region V6 is connected to a lower edge C5L of the fifth tubular region C5. An upper edge SU of the sole part S is connected to a lower edge V6L of the sixth mesh-number varying region V6.

The mesh-number varying regions V1, V2, V3, V4, V5, and V6 are regions in which the number of meshes/stitches or a width thereof changes from upwards to downwards. In an embodiment according to the present disclosure, the first, third, and fifth mesh-number varying regions V1, V3, and V5 are constituted by mesh-number increasing regions in which the number of meshes monotonically increases from upwards to downwards. Conversely, the second, fourth, and sixth mesh-number varying regions V2, V4, and V6 are constituted by mesh-number reducing regions in which the number of meshes monotonically reduces from upwards to downwards. In other words, in an embodiment according to the present disclosure, the mesh-number varying regions V1, V2, V3, V4, V5, and V6 are constituted by mesh-number increasing regions and mesh-number reducing regions arranged alternatingly along the knitting axis, the first mesh-number varying region V, which is connected to the leg part L, is constituted by a mesh-number increasing region, and the sixth mesh-number varying region V6, which is connected to the sole part 6, is constituted by a mesh-number reducing region.

Figure 4:
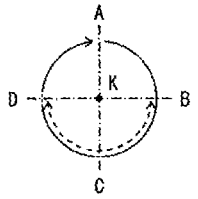
FIG. 4 is a schematic view of a cylinder of a knitting machine.

In FIG. 2 and FIGS. 3, A, B, C, and D represent locations in a circumferential direction of a cylinder of a knitting machine shown in, for example, FIG. 4. In an embodiment according to the present disclosure, the mesh-number varying regions V1, V2, V3, V4, V5 and V6 are formed by knitting while the cylinder is rotated in forward and backward directions reciprocatingly through a part of its circumference, for example, approximately half of its circumference, as indicated by a dashed line in FIG. 4. In this case, when a mesh-number increasing regions is to be formed, a rotation angle range of the cylinder is increased as the knitting proceeds from upwards toward downwards. Conversely, when a mesh-number reducing regions is to be formed, the rotation angle range of the cylinder is reduced as the knitting proceeds from upwards toward downwards. Note that, in an embodiment according to the present disclosure, the sock 1 or the mesh-number varying regions are symmetrically formed.

On the other hand, the tubular regions C1, C2, C3, C4, and C5 have a tubular shape in which the number of meshes does not change from upwards toward downwards. The tubular regions C1, C2, C3, C4, and C5 are formed by forwardly rotating the cylinder over its entire circumference, as shown by a solid line in FIG. 4. Note that, the ribbed top part R, the leg part L. and the sole part S are also formed in a tubular shape, like the tubular regions C1, C2, C3, C4 and C5.

Figure 5:
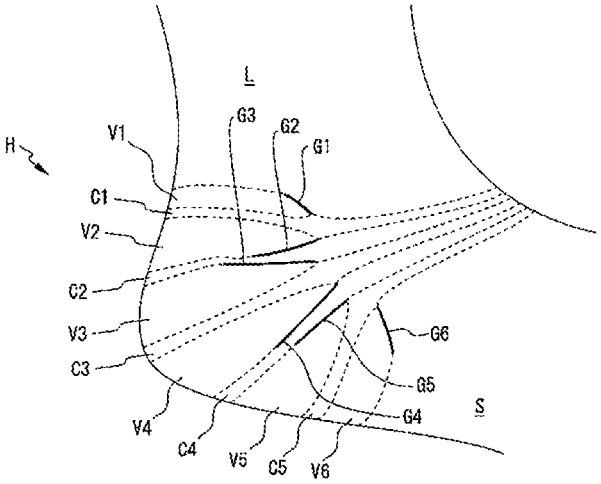
FIG. 5 is a partial schematic side view of the sock when worn.

In an embodiment according to the present disclosure, when forming the first mesh-number varying region V1, side edges V1S of the first mesh-number varying region V1 are knitted with the lower edge LL of the leg part L. As a result, first gore lines G are formed, as shown in FIG. 5. Furthermore, when forming the second tubular region C2, side edge V2S of the second mesh-number varying region V2 are knitted with the upper edge C2U of the second tubular region C2, whereby second gore lines G2 are formed. When forming the third mesh-number varying region V3, side edges V3S of the third mesh-number varying region are knitted with the lower edge C2L of the second tubular region C2, whereby third gore lines G3 are formed. When forming the fourth tubular region C4, side edges V4S of the fourth mesh-number varying region V4 are knitted with the upper edge C4U of the fourth tubular region C4, whereby fourth gore lines G4 are formed. When forming the fifth mesh-number varying region V5, side edges V5S of the fifth mesh-number varying region V5 are knitted with the lower edge C4L of the fourth tubular region C4, whereby fifth gore lines G5 are formed. When forming the sole part S, side edges V6S of the sixth mesh-number varying region V6 are knitted with the upper edge SU of the sole part S, whereby sixth gore lines G6 are formed.

In an embodiment according to the present disclosure, the number of courses or height CV1 of the first mesh-number varying region V1 is smaller than the numbers of courses of the other mesh-number varying regions, i.e., the numbers of courses CV2, CV3, CV4, CV5, and CV6 of the second to sixth mesh-number varying regions V2, V3, V4, V5, and V6. Further, in an embodiment according to the present disclosure, the number of courses CV6 of the sixth mesh-number varying region V6 is smaller than the numbers of courses CV2. CV3, CV4, and CV5 of the second to fifth mesh-number varying regions V2, V3, V4, and V5. Furthermore, in an embodiment according to the present disclosure, the numbers of courses CV2, CV3, CV4, and CV5 of the second to fifth mesh-number varying regions V2, V3, V4 and V5 are substantially equal to each other.

Thus, if the first mesh-number varying region V1, which is connected to the leg part L, is referred to as an upper mesh-number varying region, the sixth mesh-number varying region V6, which is connected to the soled part S, is referred to as a lower mesh-number varying region, and the mesh-number varying regions V2, V3, V4, and V5, which are between the upper mesh-number varying region and the lower mesh-number varying region, are referred to as intermediate mesh-number varying regions, in an embodiment according to the present disclosure, the number of courses of the upper mesh-number varying region is smaller than the number of courses of the lower mesh-number varying region and the numbers of courses of the intermediate mesh regions. Furthermore, in an embodiment according to the present disclosure, the number of courses of the upper mesh-number varying region and the number of courses of the lower mesh-number varying region are smaller than the numbers of courses of the intermediate mesh-number varying regions. Further, in an embodiment according to the present disclosure, the numbers of courses of the intermediate mesh-number varying regions are substantially equal to each other.

On the other hand, in an embodiment according to the present disclosure, the numbers of courses CC1, CC2, CC3, CC4, and CC5 of the first to fifth tubular regions C1, C2, C3, C4, and C5 are smaller than the numbers of courses CV1, CV2, CV3, CV4, CV5, and CV6 of the first to sixth mesh-number varying regions V1, V2, V3, V4, V5, and V6. Furthermore, the numbers of courses CC1, CC2, CC3, CC4, and CC5 of the first to fifth tubular regions C1, C2, C3, C4, and C5 are substantially equal to each other.

For example, the number of courses CV1 of the upper mesh-number varying region is ten, the number of courses CV6 of the lower mesh-number varying region is fourteen, the numbers of courses CV2, CV3, CV4, and CV5 of the intermediate mesh-number varying regions are each twenty-four, and the numbers of courses CC1, CC2, CC3, CC4, and CC5 are each six.

Thus, in an embodiment according to the present disclosure, the plurality of mesh-number varying regions V1, V2, V3, V4, V5 and V6 are arranged in the heel part H in a line along the knitting axis K. Generally, a mesh-number varying region has a function of projecting the heel part H outwardly (three-dimensionalization) to envelope at least a part of the heel of a wearer. As a result, any portion of the heel part H is possible to reliably envelop a heel of a wearer in both cases where a foot length of the wearer is small and where a foot length of the wearer is large.

Figure 6:
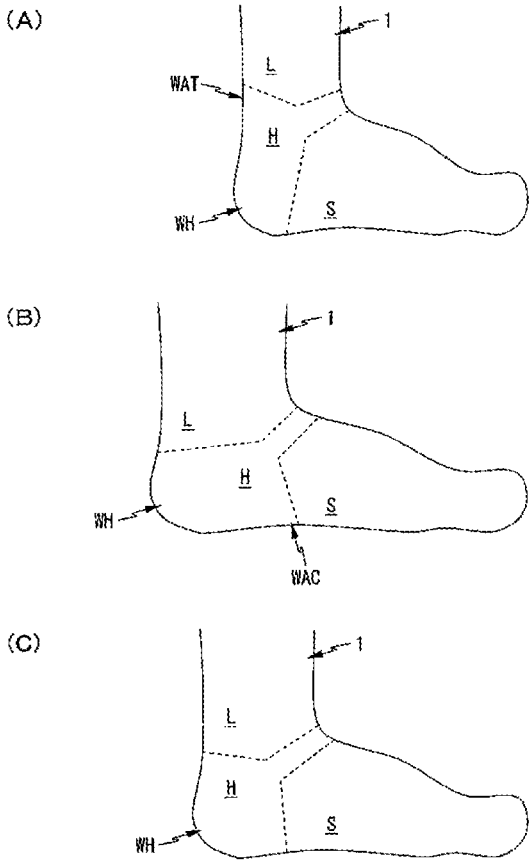
FIG. 6 shows schematic side views of socks when worn, on various foot lengths of wearers.

In other words, when a foot length of a wearer is relatively small, as shown in FIG. 6(A), mainly a portion of the heel part H of the sock 1 that is close to the sole part S envelops the heel WH of the wearer. When a foot length of a wearer is relatively large, as shown in FIG. 6(B), mainly a portion of the heel part H of the sock 1 near the leg part L envelops the heel WH of the wearer. When a foot length of a wearer is moderate, as shown in FIG. 6(C), mainly a central portion, in a direction along the knitting axis K, of the heel part H of the sock 1 envelops the heel WH of the wearer. Thus, regardless of a foot length of a wearer, the sock 1 can fit the foot of the wearer. In other words, a so-called size-free sock 1 which can accommodate variations in foot lengths of wearers is provided.

Moreover, in an embodiment according to the present disclosure, the plurality of mesh-number varying regions V1, V2, V3, V4, V5, and V6 are arranged via the plurality of tubular regions C1, C2, C3, C4, and C5. In other words, two adjacent mesh-number varying regions (e.g., the first mesh-number varying region V1 and the second mesh-number varying region V2) are connected to each other by a tubular region therebetween (e.g., the first tubular region C). As a result, the two adjacent mesh-number varying regions are easy to move relative to each other. This means that the heel part H or the mesh-number varying regions easily follow a shape of a heel of a wearer. Thus, regardless of a foot length of a wearer, the sock 1 can reliably continue to fit a heel of the wearer. Furthermore, by interposing the tubular regions C1, C2, C3, C4, and C5, the heel part H becomes large in size, and as a result, it is possible to accommodate a wider range of variation in foot lengths of wearers.

The number of the mesh-number varying regions and the number of the tubular regions may be set in any way so long as a so-called size-free sock 1 is provided. For example, it is considered that the sock 1 can accommodate a wider range of foot lengths by increasing the number of the mesh-number varying regions and the number of the tubular regions. However, if the number of mesh-number varying regions and the number of tubular regions are too large, the heel part H may be excessively large in size or the mesh-number varying regions and the tubular regions may be excessively small in size. In an embodiment according to the present disclosure, the number of the mesh-number varying regions is six and the number of the tubular regions is five. In another embodiment (not shown), the number of the mesh-number varying regions is eight and the number of the tubular regions is seven.

Note that an existing sock are known which tries to accommodate variations in foot lengths of wearers in a range of, for example, "25 to 27 cm". However, the existing sock accommodate a certain range of foot lengths merely by elasticity of the material thereof. There has not yet existed a technical idea of accommodating variations in foot lengths of wearers by a structure or knitting of the sock, as in an embodiment according to the present disclosure.

When a foot length of a wearer is relatively small, as shown in FIG. 6(A), a portion of the heel part H close to the leg part L may reach to an area around the Achilles tendon WAT of the wearer. In this case, if the heel part H around the Achilles tendon WAT of the wearer occurs sagging, this is not preferable from the viewpoint of wear comfortability or aesthetic appearance.

In an embodiment according to the present disclosure, as described above, the course number CV1 of the upper mesh-number varying region V1, which is connected to the leg part L, is set smaller than the course number CV6 of the lower mesh-number varying region V6 and the course numbers CV2, CV3, CV4, and CV5 of the intermediate mesh-number varying regions V2, V3, V4, and V5. As a result, sagging tends not to occur in the area around the Achilles tendon WAT of the wearer, and the heel part H can continue to fit the foot of the wearer, regardless of the foot length of the wearer.

Further, in an embodiment according to the present disclosure, as described above, the mesh-number varying regions V1, V3, and V5 are constituted by mesh-number increasing regions and the mesh-number varying regions V2, V4, and V6 are constituted by mesh-number reducing regions. In order words, increasing of the mesh number of the mesh-number varying region and reducing of the mesh number of the mesh-number varying region are alternatingly repeated, starting with increasing of the mesh number and ending with reducing of the mesh number, when viewed from upwards toward downwards along the knitting axis K. As a result, the first gore line G1 and the second gore line G2 are located distantly from each other, the second gore line G2 and the third gore line G3 are located closely to each other, the third gore line G3 and the fourth gore line G4 are located distantly from each other, the fourth gore line G4 and the fifth gore line G5 are located closely to each other, and the fifth gore line G5 and the sixth gore line G6 are located distantly from each other, as shown in FIG. 5.

Figure 7:
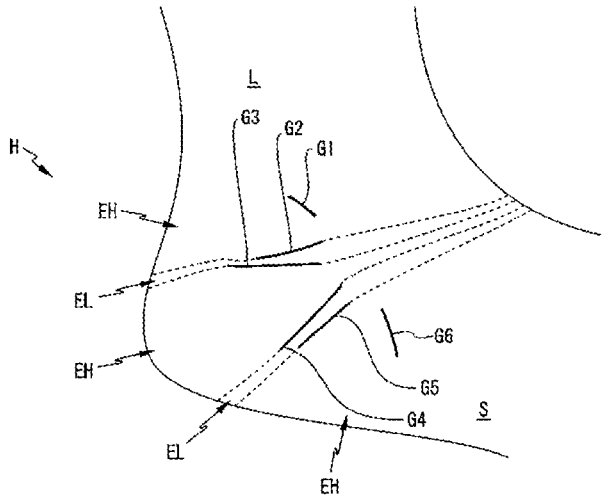
FIG. 7 is a partial schematic side view of the sock when worn.

Generally, a gore line is known to have low elasticity in its longitudinal direction. Thus, in the heel part H, a portion interposed between the first gore line G1 and the second gore line G2, a portion interposed between the third gore line G3 and the fourth gore line G4, and a portion interposed between the fifth gore line G5 and the sixth gore line G6, when viewed in a direction along the knitting axis K, where no gore line is formed, are formed with high circumferential-elasticity portions EH, which have a relatively high elasticity in the circumferential direction, as shown in FIG. 7. Furthermore, in the heel part H, since a portion interposed between the second gore line G2 and the third gore line G3 and in a portion interposed between the fourth gore line G4 and the fifth gore line G5, when viewed in a direction along the knitting axis K, where two gore lines are close to each other, are formed with low circumferential-elasticity portions EL, which have a relatively low elasticity in the circumferential direction. In this case, the area or the number of courses of the high circumferential-elasticity portions EH is larger than the area or the number of courses of the low cir-cumferential-elasticity portions EL.

As a result, the high circumferential-elasticity portions EH can wrap or envelope a heel of a wearer securely, and at the same time, the low circumferential-elasticity portions EL can prevent the heel of the wearer from moving relative to the sock 1 in the direction along the knitting axis K. In other words, regardless of a foot length of a wearer, the sock 1 can continue to more securely fit to a heel of the wearer.

Note that, in an embodiment according to the present disclosure, an elasticity of a portion of the sole part S, which is adjacent to the heel part H, is made greater than those of other portions of the sole part S, the leg part L, the heel part H, and the toe part T. As a result, the sock 1 can continue to better fit to a foot of a wearer. Ad-justment of an elasticity can be performed by adjusting, for example, a knitting method or material.

Figure 8:
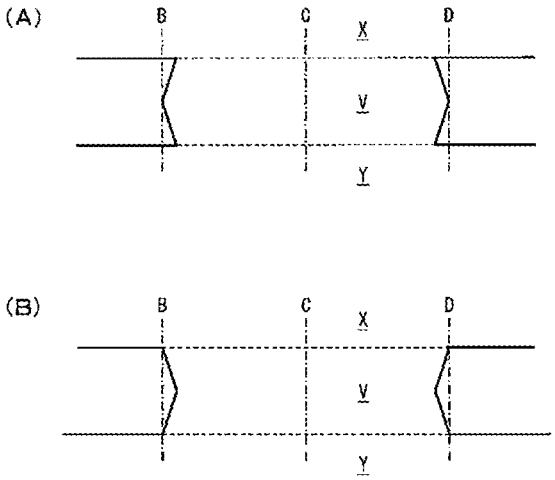
FIG. 8 is a partial development view of the heel part, showing another embodiment of a mesh-number varying region.

In the above-described embodiments according to the present disclosure, the mesh-number varying regions are constituted by the mesh-number increasing regions and mesh-number reducing regions. However, the mesh-number varying regions can be constituted by mesh-number fluctuating regions. The mesh-number fluctuating regions include, from upwards toward downwards, at least one portion in which a mesh number increases and at least one portion in which a mesh number reduces. Various examples of the mesh-number fluctuating regions are shown in FIG. 8(A) and FIG. 8(B). In the example shown in FIG. 8(A), the mesh number of the mesh-number varying region V first increases and then reduces from upwards toward downwards. In the example shown in FIG. 8(B), the mesh number of the mesh-number varying region V first reduces and then increases from upwards toward downwards. Note that in FIG. 8(A) and FIG. 8(B), X represents the leg part L or the tubular region, and Y represents the tubular region or the sole part S.

Furthermore, in the above-described embodiments according to the present disclosure, the mesh-number varying regions are constituted by a combination of mesh-number increasing regions and mesh-number reducing regions. However, the mesh-number varying regions may be constituted by appropriately combining mesh-number increasing regions, mesh-number reducing regions, and mesh-number fluctuating regions. In one example, all of the mesh-number varying regions are constituted by mesh-number fluctuating regions.

Further, in the above-described embodiments according to the present disclosure, the mesh-number varying regions are constituted by the mesh-number increasing regions and the mesh-number reducing regions which are arranged alternatingly, the upper mesh-number varying region is constituted by the mesh-number increasing region, and the lower mesh-number varying region is constituted by the mesh-number reducing region. In this case, three high circumferential-elasticity portions EH and two low cir-cumferential-elasticity portions EL are formed in the heel part H, as shown in FIG. 7. In another embodiment (not shown), the mesh-number varying regions are constituted by the mesh-number increasing regions and the mesh-number reducing regions which are arranged alternatingly, the upper mesh-number varying region is constituted by the mesh-number reducing region, and the lower mesh-number varying region is constituted by the mesh-number increasing region. In this case, two high circumferential-elasticity portions EH and three low circumferential-elasticity portions EL are formed in the heel part H.

The present disclosure includes the following examples.

Example 1

A sock formed by circular knitting or flat knitting along a knitting axis, the sock comprising:

a tubular leg part;

a tubular sole part; and a heel part between the leg part and the sole part, the heel part comprising:

a plurality of mesh-number varying regions arranged along the knitting axis; and a plurality of tubular regions arranged between the mesh-number varying regions, the mesh-number varying regions including:

an upper mesh-number varying region connected to a lower edge of the leg part;

a lower mesh-number varying region connected to an upper edge of the sole part; and a plurality of intermediate mesh-number varying regions between the upper mesh-number varying region and the lower mesh-number varying region, wherein the number of courses of the upper mesh-number varying region is smaller than the number of courses of the lower mesh-number varying region and the number of courses of the intermediate mesh-number varying regions.

Example 2

The sock according to Example 1, wherein the mesh-number varying regions are constituted by mesh-number increasing regions and mesh-number reducing regions alternately arranged along the knitting axis.

Example 3

The sock according to Example 2, wherein the upper mesh-number varying region is constituted by a mesh-number increasing region and the lower mesh-number varying region is constituted by a mesh-number reducing region.

Example 4

The sock according to any one of Examples 1 to 3, wherein the number of the mesh-number varying regions is six and the number of the tubular regions is five, or the number of the mesh-number varying regions is eight and the number of the tubular regions is seven.

Example 5

A sock formed by circular knitting or flat knitting along a knitting axis, the sock comprising:

a tubular leg part;

a tubular sole part; and a heel part between the leg part and the sole part, the heel part comprising:

a plurality of mesh-number varying regions arranged along the knitting axis; and a plurality of tubular regions arranged between the mesh-number varying regions, the mesh-number varying regions including:

an upper mesh-number varying region connected to a lower edge of the leg part;

a lower mesh-number varying region connected to an upper edge of the sole part; and a plurality of intermediate mesh-number varying regions between the upper mesh-number varying region and the lower mesh-number varying region, wherein the mesh-number varying regions are constituted by mesh-number increasing regions and mesh-number reducing regions alternately arranged along the knitting axis.

Example 6

A sock formed by circular knitting or flat knitting along a knitting axis, the sock comprising:

a tubular leg part;

a tubular sole part; and a heel part between the leg part and the sole part, the heel part comprising:

a plurality of mesh-number varying regions arranged along the knitting axis; and a plurality of tubular regions arranged between the mesh-number varying regions, the mesh-number varying regions including:

an upper mesh-number varying region connected to a lower edge of the leg part;

a lower mesh-number varying region connected to an upper edge of the sole part; and a plurality of intermediate mesh-number varying regions between the upper mesh-number varying region and the lower mesh-number varying region, wherein, in order to accommodate variations in foot length of wearers, the number of the mesh-number varying regions is six and the number of the tubular regions is five or the number of the mesh-number varying regions is eight and the number of the tubular regions is seven.

REFERENCE SIGNS LIST

1—sock

L—leg part

H—heel part

S—sole part

V1, V2, V3, V4, V5, V6—mesh-number varying regions

V1—upper mesh-number varying region

V6—lower mesh-number varying region

V2, V3, V4, V5—intermediate mesh-number varying regions

C1, C2, C3, C4, C5—tubular regions

CV1—number of courses of upper mesh-number varying region

CV6—number of courses of lower mesh-number varying region

CV2, CV3, CV4, CV5—number of courses of intermediate mesh-number varying regions K—knitting axis

The invention claimed is:

1. A sock formed by circular knitting or flat knitting along a knitting axis, the sock comprising:

a leg part;

a sole part; and a heel part between the leg part and the sole part, the heel part comprising:

a plurality of mesh-number varying regions arranged along the knitting axis, wherein each of the plurality of mesh-number varying regions is defined as only a mesh-number increasing region or a mesh-number decreasing region, and wherein the mesh-number increasing regions and the mesh-number decreasing regions are alternatingly arranged along the knitting axis;

a plurality of tubular regions arranged such that each one of the plurality of tubular regions is interposed with a corresponding pair of the alternating mesh-number increasing regions and the mesh-number decreasing regions, the plurality of tubular regions including first ones and second ones, such that each of the first ones have a leg side edge abutting the mesh-number increasing region and a sole side edge abutting the mesh-number decreasing region, and each of the second ones have a leg side edge abutting the mesh-number decreasing region and a sole side edge abutting the mesh-number increasing region, and the plurality of mesh-number varying regions further including:

an upper mesh-number varying region connected to a lower edge of the leg part;

a lower mesh-number varying region connected to an upper edge of the sole part; and a plurality of intermediate mesh-number varying regions between the upper mesh-number varying region and the lower mesh-number varying region, wherein the number of courses of the upper mesh-number varying region is smaller than each of the number of courses of the lower mesh-number varying region and the number of courses of the intermediate mesh-number varying regions, and wherein the number of courses of the tubular regions is smaller than the number of courses of the mesh-number varying regions.

2. The sock according to claim 1, wherein the upper mesh-number varying region is constituted by a mesh-number increasing region and the lower mesh-number varying region is constituted by a mesh-number reducing region.

3. The sock according to claim 1, wherein the number of the mesh-number varying regions is six and the number of the tubular regions is five, or the number of the mesh-number varying regions is eight and the number of the tubular regions is seven.

4. The sock according to claim 2, wherein the number of the mesh-number varying regions is six and the number of the tubular regions is five, or the number of the mesh-number varying regions is eight and the number of the tubular regions is seven.

* * * * *